United States Patent [19]

Koenig

[11] Patent Number: 4,732,286

[45] Date of Patent: Mar. 22, 1988

[54] CRANE WITH OVERLOAD SENSOR

[75] Inventor: Richard F. Koenig, Houston, Tex.

[73] Assignee: Rawson-Koenig, Inc., Houston, Tex.

[21] Appl. No.: 707,487

[22] Filed: Mar. 1, 1985

[51] Int. Cl.[4] ..... B66C 13/18

[52] U.S. Cl. ..... 212/149; 212/153; 340/685

[58] Field of Search ..... 212/149, 150, 153, 154, 212/155; 414/744 R; 901/49; 340/685, 689, 665

[56] References Cited

U.S. PATENT DOCUMENTS

| | | | |
|---|---|---|---|
| 2,910,189 | 10/1959 | Scheuerpflug | 212/59 |
| 3,357,571 | 12/1967 | Bougton | 212/39 |
| 3,824,578 | 7/1974 | Harders | 340/267 |
| 3,952,879 | 4/1976 | Grove | 212/149 |
| 4,067,446 | 1/1978 | Ray | 212/48 |
| 4,427,121 | 1/1984 | Clements | 212/231 |

FOREIGN PATENT DOCUMENTS

| | | | |
|---|---|---|---|
| 1556339 | 2/1970 | Fed. Rep. of Germany | 212/150 |
| 2020167 | 11/1971 | Fed. Rep. of Germany | 212/149 |

*Primary Examiner*—Sherman D. Basinger
*Assistant Examiner*—Thomas J. Brahan
*Attorney, Agent, or Firm*—John S. Egbert

[57] ABSTRACT

The present invention is an improved crane comprising a base, a support member connected to and extending upwardly from the base, a deformable member attached to the support member, a microswitch and actuator fastened to the support member and arranged so as to be interactive with the deformable member for sensing the relative displacement of the deformable member with respect to the support member, and a winch/boom lifting system. The deformable member comprises a flange plate fixedly attached to the support member. The flange plate is a load bearing member for the crane. An enclosure is affixed to the flange plate. The switch and actuator portion comprises a bar rigidly affixed to the support member, a microswitch fastened about the other end of the bar, a movement sensor abutting the flange plate, and a control circuitry electrically connected to the microswitch and responsive to the movement sensor so as to enable or disable the lifting system of the crane.

15 Claims, 6 Drawing Figures

CRANE WITH OVERLOAD SENSOR

TECHNICAL FIELD

The present invention relates to cranes and the components therefor. More particularly, the present invention relates to detection and control systems for detecting and preventing overloads affecting the support structure of a crane.

BACKGROUND ART

In the past, sensor systems have been commonly employed in cranes to detect overloads affecting the boom and cable of the crane. However, such load sensors have had limited application in the past in detecting and preventing excessive torque applied to the base or turret of such a crane.

When cranes lift large amounts of weight, a great amount of torque is applied to the base of the crane. The amount of torque applied will be a function of the weight being lifted, and the distance from the base of the crane to the cable attached to the load, measured perpendicularly to the cable. In many instances, a destructive amount of torque can be applied to the base of the crane without causing excessive strain and stresses on the lifting boom. This is particularly true for the smaller truck-mounted cranes. Certain U.S. patents have described overload sensors and limit switches that are associated with the base of cranes. U.S. Pat. No. 3,357,571, issued to J. H. Boughton, described a microswitch that is responsive to the angular movement of the superstructure of a tractor-mounted crane. A microswitch is attached to two horizontal flanges. These horizontal flanges correspond to the superstructure and base of the crane. When excessive loads are being lifted by the crane, the angular separation of these horizontal flanges will actuate the microswitch so as to sound a warning.

U.S. Pat. No. 1,614,575, issued to C. T. Siebs, shows a limit switch arranged about the base of the cab of a tractor-mounted crane. This limit switch is responsive to rotational movements of the cab relative to the platform. This limit switch, however, is used only for sensing the angular position of the crane relative to the tracks. It did not have application for sensing base-affecting bending loads caused by excessive torque. Several other patents have issued that relate to sensors that detect overloads affecting crane systems. These patents include U.S. Pat. No. 2,910,189; U.S. Pat. No. 3,824,578; U.S. Pat. No. 4,067,446; and U.S. Pat. No. 4,427,121.

It is an object of the present invention to provide an improved crane that has a sensor for detecting excessive torques about the base of the crane.

It is another object of the present invention to provide a relatively inexpensive and easy-to-manufacture overload sensor system for truck-mounted cranes.

It is a further object of the present invention to provide an overload sensor for a crane that both detects and prevents destructive overloads during the lifting or moving of objects.

These and other objects and advantages of the present invention will become apparent from a reading of the attached specification and appended claims.

DISCLOSURE OF THE INVENTION

The present invention is an improved crane comprising a base, a support member, a frame, a switching element, and a lifting system. The support member is connected the base. The frame is attached to the support member. The switching element is fastened to the support member and is arranged so as to be interactive with the frame for detecting the relative displacement of the frame with respect to the support member. The lifting system is a winch/boom system that is connected to the frame and adapted for lifting and moving objects located a distance from the crane frame.

The base comprises a generally flat plate and a cylindrical member rigidly fastened to one side of the flat plate. The flat plate has a plurality of apertures for fastening the base to a surface on a moving vehicle. The support member comprises a generally cylindrical column rotatably mounted to and concentric with the cylindrical member of the base. The longitudinal axis of this cylindrical column should be perpendicular to the flat plate of the base. The frame includes a deformable flange plate fixedly attached to the support member. The deformable plate is a load bearing member of the crane. The support member is attached generally about the center of the deformable plate. The lifting system is arranged such that the lifting load forces act on a portion of the deformable plate. The switching element is arranged so as to sense the relative displacement of the flange plate with respect to the support member. The flange plate is designed to deform elastically under normal load sufficient to actuate the switching element by suitable choice of shape and material. The deformable flange plate further may have indentations along each of the sides between the forward portion and the rearward portion. This indentation is a roughly W-shaped cut and may extend through the thickness of the flange plate. The frame further comprises a boom mount rigidly fastened to the enclosure and to the flange plate. This boom mount has a plurality of apertures extending therethrough.

The switching element of the present invention comprises a bar rigidly affixed at one end to the support member, a microswitch or other type of actuatable switch fastened generally about the other end of the bar, and a controller electrically connected to the microswitch. The microswitch has a movement sensor extending therefrom and arranged so as to be responsive to the movement of the flange plate relative to the support member. The microswitch is responsive to the movements of the movement sensor. The controller includes a lift switch electrically connected to the lifting system. The movement sensor causes the lift switch to activate or deactivate the lifting system. The bar has a hole about the end opposite the support member. The movement sensor has a threaded section thereabout. This threaded section of the movement sensor extends through the hole of the bar. The movement sensor also has at least one nut about the threaded section so as to allow it to be adjustably positioned relative to the bar and the deformable flange plate. The microswitch is a single-pole/double-throw switch.

The lifting system of the present invention comprises a winch mounted to the frame, a lifting boom connected to and extending outwardly from the frame, and a cable attached to the winch and extending outwardly over a sheave on the lifting boom.

BEST MODE FOR CARRYING OUT THE INVENTION

Figure 1:
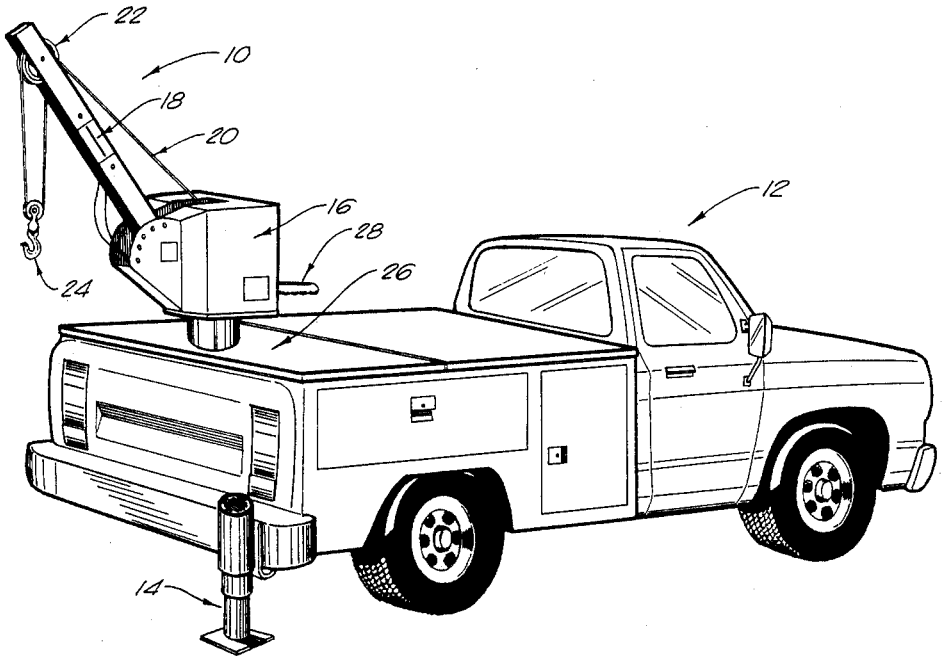
FIG. 1 is a view in side elevation of a truck having the improved crane of the present invention mounted thereto.

Referring to FIG. 1, there is shown at 10 the improved crane of the present invention. In FIG. 1, crane 10 is fastened to the rear portion of truck 12. Truck 12 may be any of a variety of different moving vehicles. The improved crane 10 of the present invention is adaptable to a wide variety of vehicles. Crane 10 provides heavy-duty lifting capability for truck 12. Truck 12 may include a jack 14 that stabilizes the vehicle and provides support for the lifting of objects by crane 10.

As shown is FIG. 1, crane 10 includes a rotatable turret 16, a boom 18, cable 20, sheave 22, and hoist hook 24. Turret 16 rotates and is adjustable relative to the base 26 that connects the crane 10 with truck 12. A handle 28 allows the operator of the crane to properly adjust and position the crane thoughout a 360° rotation of turret 16. Boom 18 is connected and extends from rotatable turret 16. Boom 18 is fixedly positionable, as will be described hereinafter, through a wide range of angles relative to the turret 16. Cable 20 extends from the winch within turret 16 over and through sheave 22, and connects with hoist hook 24. The combination of each of these components allows each truck to have heavy duty material handling and lifting capability.

Figure 2:
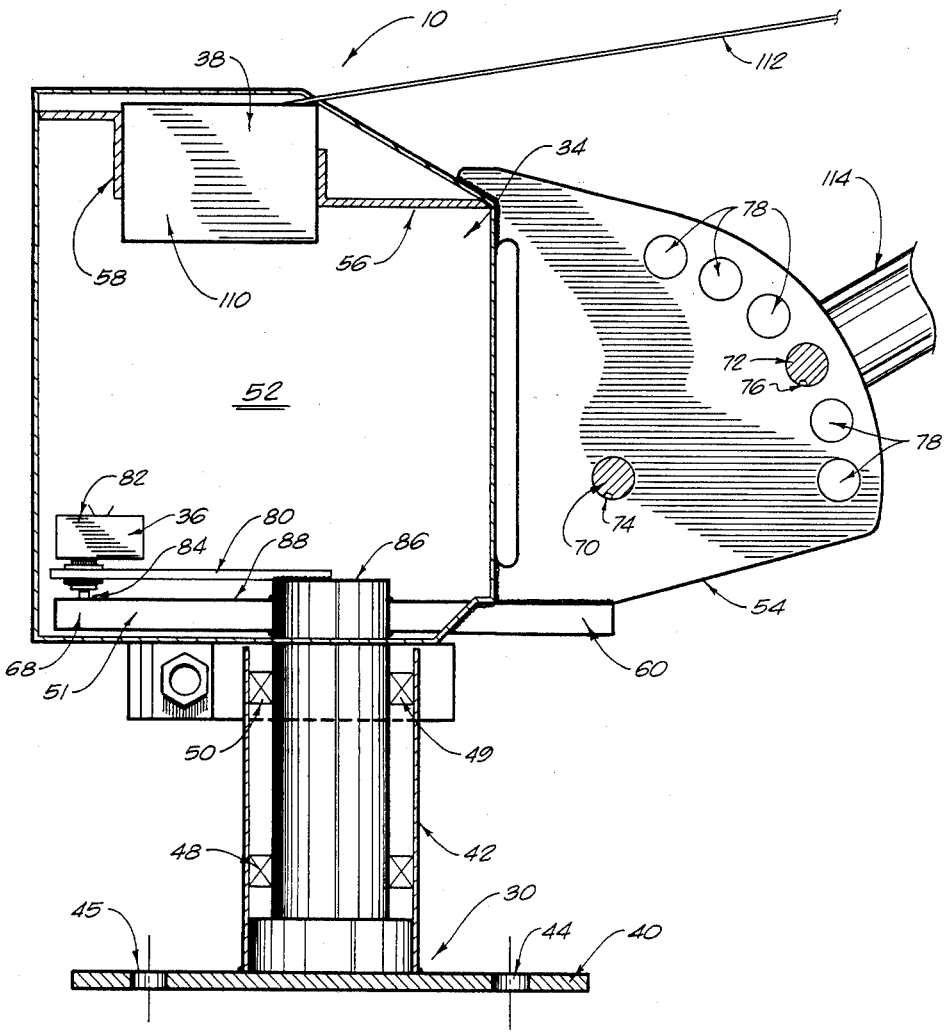
FIG. 2 is a cross-sectional view in side elevation of the improved crane overload sensor system of the present invention.

FIG. 2 is a cross-sectional view of the turret 16 and base 26 of crane 10. As shown in FIG. 2, crane 10 comprises a base 30, a support member 32, a frame 34, a switching element 36, and a lifting system 38.

The base 30 comprises a generally flat plate 40 and a cylindrical member 42 rigidly fastened to one side of the flat plate 40. Flat plate 40 includes holes 44 and 45 extending through the thickness of the flat plate. Holes 44 and 45 are arranged so as to receive bolts. These bolts allow the crane assembly 10 to be rigidly fastened to a surface on a moving vehicle. Cylindrical member 42 is welded to the upper surface of flat plate 40. Cylindrical member 42 extends upwardly toward the frame 34.

Support member 32 comprises a cylindrical column rotatably mounted within the cylindrical member 42. The longitudinal axis of the cylindrical column is perpendicular to the flat plate 40. As shown in FIGURE 2, cylindrical column 32 is concentric with cylindrical member 42. Bearing sets 48 and 49 are positioned between the inner wall of cylindrical member 42 and the surface of cylindrical column 32. These bearing sets 48 and 49 provide the rotation capability of turret 16 relative to the base 26 as shown in FIG. 1. These bearing sets 48 and 49 also serve to provide the means whereby the cylindrical column 32 is maintained in perpendicular position relative to the base 30. Although not shown, bearing spacers, bearing clamp plates, and bearing cups may also be provided to facilitate this arrangement. The arrangement of bearings and the technique of positioning the support member 32 within the cylindrical member 42 is just one technique of providing the rotational capability of the turret 16 relative to the base 26. This should not be construed as a limitation of the present invention.

Frame 34 includes a deformable flange plate 51, an enclosure 52, a boom mount 54, and winch support brackets 56 and 58. The cylindrical column 32 extends upward through the cylindrical member 42 of base 30 and through deformable flange plate 51. Flange plate 51 is welded to the upper portion of the cylindrical column 32. Flange plate 51 extends circumferentially about the surface of cylindrical column 32. Under no-load conditions, flange plate 51 is generally parallel to the flat plate 40 of base 30. Flange plate 51 has boom mount 54 rigidly affixed to the forward portion 60. Flange plate 51 also acts on overload sensor 36 so as to provide the overload sensing capabilities of the present invention.

Figure 3:
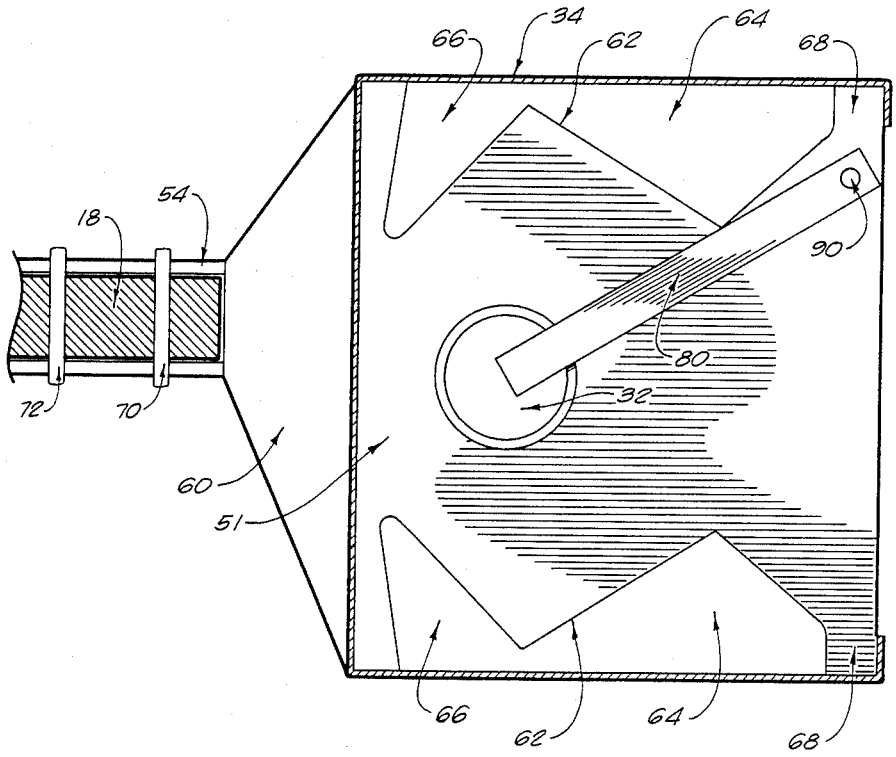
FIG. 3 is top view in cross-section of the improved crane overload sensor system of the present invention.
Figure 4:
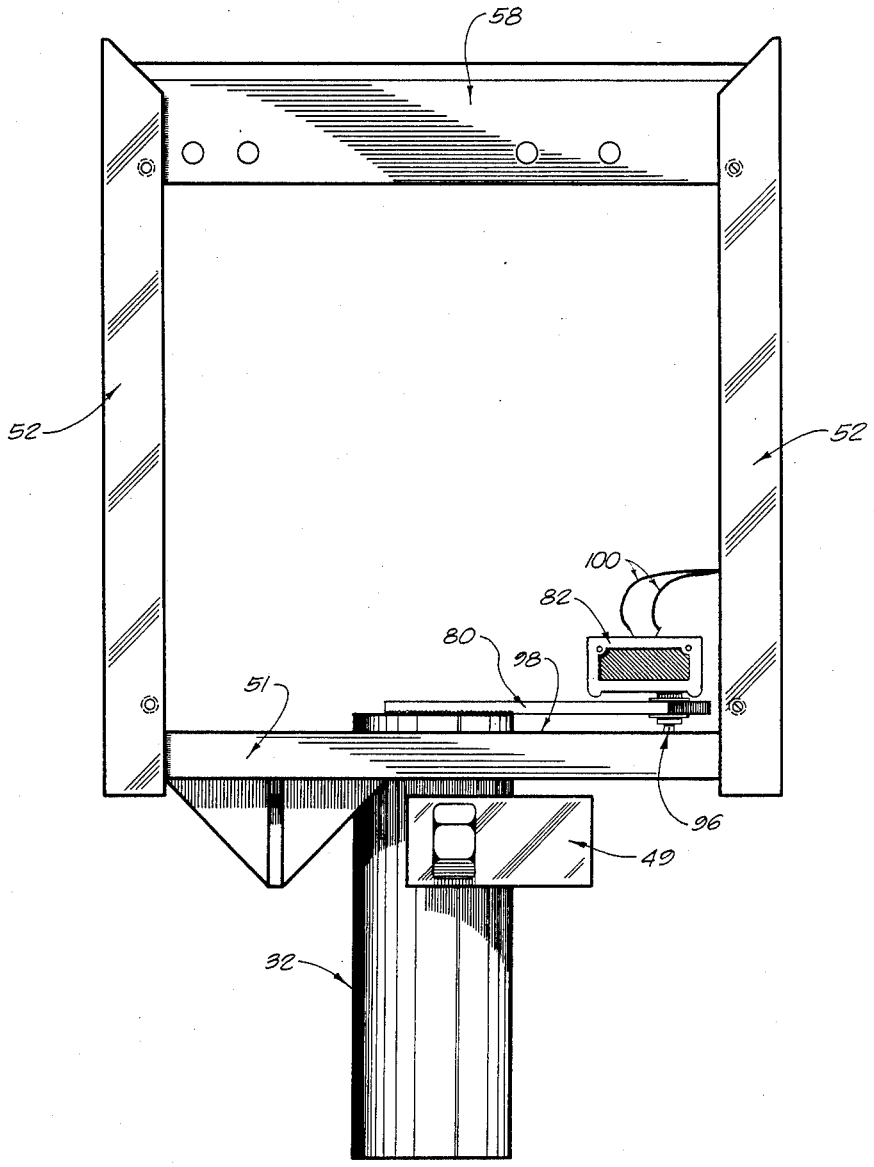
FIG. 4 is rear view of the improved crane overload sensor system of the present invention.

The flange plate 51 is shown in greater detail in the top view of FIG. 3. Flange plate 51 is a generally flat, thick section of steel. The forward portion 60 of flange plate 51 tapers inwardly toward boom 18 and boom mount 54. The forward portion 60 is a major load bearing member of the crane of the present invention. Flange plate 51 has a unique configuration that facilitiates the operation of the overload sensor. Specifically, flange plate 51 has symmetrical indentations 62 extending along the sides of flange plate 51. These indentations 62 are roughly W-shaped and extend through the thickness of the flange plate. As a result, there are open areas 64 and 66 between the flange plate and the enclosure 52. The configuration of these indentations 62 cause a greater flexing action in the rearward portions 68 of flange plate 51 when a load is placed on the forward portion 60 of the flange plate. The enclosure 52 has a roughly U-shaped configuration as viewed in FIG. 3. Enclosure 52 is welded to the rearward portion 68 of flange plate 51 at the corners. The enclosure 52 also extends across the other side of flange plate 51. While FIGS. 2, 3, and 4 illustrate the enclosure as being welded to the flange plate 51, it should be noted that the enclosure 52 can be attached to the flange plate 51 in a variety of different ways.

In FIG. 3, it can also be seen that the boom 18 is fastened to the boom mount 54 by hinge pin 70 and position pin 72. Boom 18 has two apertures that extend through its thickness. One of these apertures is a hinge aperture 74. Hinge aperture 74 aligns with the hole in the mounting plate 54 so as to permit hinge pin 70 to engage the boom 18 with the boom mount 54. The boom 18 also has another aperture 76 that aligns with the holes 78 of boom mount 54. As a result of this alignment, position pin 72 can be inserted through these holes so as to maintain the boom 18 in its desired position. The aperture 76 may also align with the other holes 78 so as to permit the adjusting and angular positioning of the boom 18.

Figure 6:
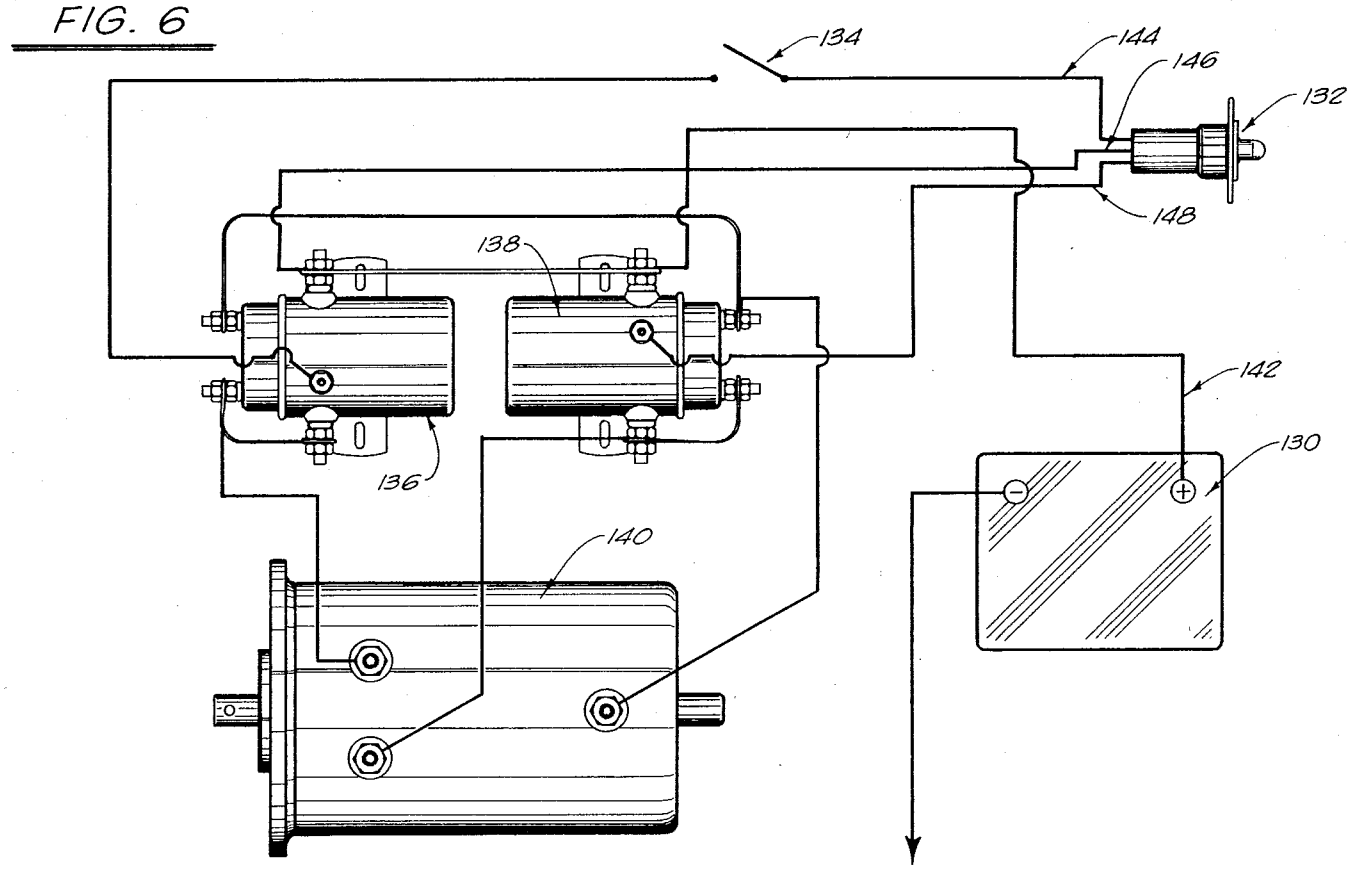
FIG. 6 is a schematical representation of the electrical wiring of the present invention.

The overload sensor system of crane 10 is a very important and unique aspect of the present invention. This overload sensor utilizes a microswitch or other switching element in combination with the structural arrangement of the crane 10, so as to provide for the sensing of overload forces acting on the base of crane 10. Specifically, the overload sensor 36 comprises a bar 80, a microswitch 82, a movement sensor 84, and a control system (as shown in FIG. 6). The bar 80 is rigidly affixed at one end to the top 86 of support column 32. Bar 80 may be affixed to support column 32 by welding, bolting, or other means. Bar 80 extends from the top 86 of support column 32 outwardly and generally parallel to the top surface 88 of deformable flange plate 51. The bar 80 extends outwardly, at an angle, toward the corners of the rearward portion 68 of flange plate 51. The bar 80 is positioned in this manner since the corners of flange plate 51 will have the maximum deflection during the loading of the flange plate. At the end of the bar 80, opposite support column 32, is a hole 90 that extends through the thickness of bar 80. Hole 90 is for the receipt of the microswitch 82 of the overload sensor 36.

Figure 5:
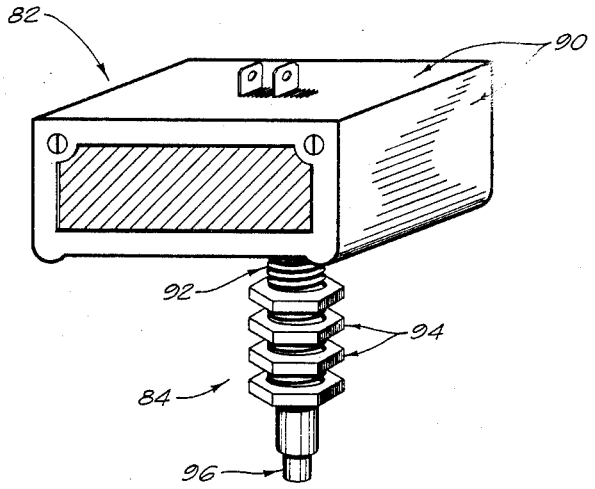
FIG. 5 is a perspective view of the switching element and actuator of the improved crane overload sensor of the present invention.

FIG. 5 shows the microswitch 82 and movement sensor 84 of the present invention. The microswitch 82 is a single-pole, double-throw microswitch. The microswitch used in the present invention is manufactured by Micro Switch, Inc., a Honeywell Division. These switches are specifically designed for the control of motors, solenoids, etc. The movement sensor 84 is an actuator that fits about the body of microswitch 82. Movement sensor 84 has a frame 90, a threaded section 92 extending from the frame 90, jam nuts 94, and a pin plunger 96. As can be seen in FIGS. 2 and 4, microswitch 82 is mounted to the top side of bar 80. The threaded section 92 of movement sensor 84 passes through hole 90 of bar 80. The pin plunger 96 is adjustably positioned such that the end of the pin plunger 96 abuts the top surface 98 of flange plate 51. The movement sensor 84 can be effectively calibrated and aligned by suitable adjustments of the jam nuts 94 about threaded section 92 in hole 90. Microswitch 82 has leads 100 extending therefrom.

The lifting system 38 is illustrated in FIGURES 1 and 2. As used herein, the terms "lifting means" and "lifting system" may include other mechanical actions, such as pulling, towing, moving, etc. Lifting system 38 comprises a winch 110, a cable 112, lifting boom 114, and hoist hook 24 (as shown in FIG. 1). The winch 110 is a power winch that reels the cable 112 in one direction or the other. Winch 110 may be powered from the battery of the truck 12. In FIG. 2, winch 110 is mounted to brackets 56 and 58. Brackets 56 and 58 are rigidly secured to the frame 34. Cable 112 extends from the winch 110 outwardly over and through sheave 22. Cable 112 should have a sufficient integrity to withstand the loads that would be placed on it during lifting activity. The hoist hook 24 is a standard type of swivel hook having a safety latch attached thereto. Hook 24 is used for grasping the mauerial load to be lifted by crane 10. The sheave 22 is rotatably mounted about the end of boom 18 opposite the frame 16.

FIG. 6 illustrates the electronics of the present invention. The components illustrated in FIGURE 6 include battery 130, control switch 132, switch 134, solenoids 136 and 138, and winch motor 140. In battery 130, the negative terminal is attached to the winch assembly and is thereby grounded. The positive terminal is connected by line 142 to solenoids 136 and 138. The control switch 132 is connected by line 144 to solenoid 136 which controls the lifting rotation of the winch motor. Control switch 132 is also connected by line 146 to the positive terminal of battery 130. Additionally, control switch 132 is connected by line 148 to solenoid 138. Switch 134 is in line 144. In FIG. 6, switch 134 is shown in its open position. In this open position, switch 134 operates to prevent any lifting actions caused by winch 140. In this arrangement, lowering movements caused by winch 140 are permitted by this electronic scheme. In the closed position, switch 134 would permit both lifting and lowering actions by the winch 140. Solenoids 136 and 138 are electrically connected to several terminals about winch motor 140. The solenoids assist in passing heavy power loads to the winch.

In operation, the overload sensor of the crane 10 of the present invention serves to prevent excessive torques from being applied to the flange plate/base of the crane during lifting actions. Without the overload sensor arrangement of the present invention, excessive and damaging loads could be lifted by the crane which could prove destructive to the crane turret 16 and to the base 26. The arrangement of the microswitch, in combination with the structural arrangement of the crane 10, facilitates this ability to prevent the lifting of excessive and damaging loads.

As shown in FIG. 2, the crane is shown as lifting normal loads. In this arrangement, the bar 80 is generally in parallel with the top of the flange plate 88. In this position, the movement sensor 84 is in its normal position. In this "normal" position, switch 134 (as seen in FIG. 6) is closed so as to permit continued lifting actions by the winch 140.

When excessive loads are being lifted by crane 10, the overload sensor of the present invention operates to prohibit these excessive loads from damaging the base/flange plate of the crane. When an excessive load is being lifted by hoist hook 24, a strong moment is applied by the boom 18 upon the boom mount 54. This, in turn, places a heavy load on deformable flange plate 51. This also places a strong torque on the enclosure 52 of frame 34. During the lifting of these loads, the support column 32 should maintain a relatively fixed position with regard to the base 30. As such, bar 80 should maintain a relatively fixed position with respect to the base 30. Importantly, however, the strong torque applied by the lifting of these heavy loads will cause the rearward portion 68 of deformable flange plate 51 to bend and move toward bar 80. The movement of the rearward portion of flange plate 51 toward bar 80 will cause pin plunger 96 to be slowly depressed into movement sensor 84. The depressing of pin plunger 96 within movement sensor 84 causes microswitch 82 to be actuated. The actuating of microswitch 82 causes the switch 134 (in FIG. 6) to be in its open position. As a result, the lifting actions produced by the winch 110 are stopped. The load may not be lifted any further by crane 10. The opening of switch 134 means that the load can only be lowered.

This overload sensor arrangement for crane 10 is a significant safety feature for these truck-mounted cranes. In addition, this overload sensor will prevent the potential destruction of the turret mounting arrangement of the crane. Thus, the crane should have a longer life expectancy.

The foregoing disclosure and description of the invention is illustrative and explanatory thereof, and various changes in size, shape, and materials as well as in the details of the illustrated construction, or described operation, may be made within the scope of the appended claims without departing from the spirit of the invention. This invention should only be limited by the appended claims and their legal equivalents.

I claim:

1. An improved crane comprising:

a base;

a support member connected to and extending from said base;

a deformable member fixedly attached to said support member, said deformable member comprising a flange plate, said flange plate being a load bearing member;

switching means fastened to said support member and interactive with said flange plate so as to sense the relative deformation of said flange plate with respect to said support member said switching means comprising;

a bar rigidly affixed at one end to said support member:

a switch fastened to the other end of said bar, said switch having a movement sensor extending therefrom and responsive to movements of said flange plate; and control means electrically connected to said switch and responsive to said movement sensor; and lifting means fastened to said deformable member, said lifting means for moving objects.

2. The crane of claim 1, said base comprising:

a generally flat plate; and a cylindrical member rigidly fastened to one side of said flat plate.

3. The crane of claim 2, said flat plate having a plurality of apertures for fastening said base to a surface on a moving vehicle.

4. The crane of claim 2, said support member comprising:

a generally cylindrical column rotatably mounted to an generally concentric with said cylindrical member of said base, the longitudinal axis of said cylindrical column being generally perpendicular to said flat plate.

5. The crane of claim 1, said flange plate having an identation along each of the sides of said flange plate between said forward portion and said rearward portion.

6. The crane of claim 5, said indentation being a roughly W-shaped cut, said W-shaped cut extending through the thickness of said flange plate.

7. The crane of claim 1, further comprising:

an enclosure affixed to said flange plate; and a boom mount rigidly fastened to said enclosure and to said flange plate, said boom mount having a plurality of apertures extending therethrough.

8. The crane of claim 7, said lifting means comprising:

a winch mounted within said enclosure; a lifting boom pivotally hinged about one of said apertures in said boom mount, said lifting boom angularly adjustable and fixedly positionable relative to the other apertures in said boom mount, said lifting boom having a sheave rotatably mounted about the end opposite said boom mount; and a cable attached to said winch at one end and extending outwardly about said lifting boom and over said sheave.

9. The crane of claim 8, said lifting means further comprising:

a hinge pin extending through said one of said apertures in said boom mount and through an opening in said lifting boom; and a position pin extending through at least one of said other apertures in said boom mount and through an opening in said lifting boom, said position pin being distal from said hinge pin.

10. The crane of claim 1, said control means comprising:

a lift switch electrically connected to said lifting means, the movement of said movement sensor causing said lift switch to activate or deactivate said lift means.

11. The crane of claim 1, said bar having a hole about the end opposite said support member, said movement sensor having a threaded section thereabout, said threaded section of said movement sensor extending through said hole of said bar, said movement sensor having at least one nut about said threaded section, said nut for adjustably positioning said movement sensor relative to said bar and said flange plate.

12. The crane of claim 1, said switch being a single-pole, double-throw magnetic switch.

13. The crane of claim 1, further comprising:

an enclosure affixed to said deformable member;

said lifting means comprising:

a winch mounted in said frame;

a lifting boom connected to and extending outwardly from said frame, said lifting boom having a sheave rotatably mounted thereto; and a cable attached to said winch at one end and extending outwardly about said lifting boom and over said sheave.

14. A crane overload sensor for use in a crane having a support member for maintaining said crane in a position relative to the earth and a deformable plate affixed about the upper portion of said support member, said crane of the type that applies a torque to said plate during the lifting of objects, said overload sensor comprising:

a non-working-load-bearing bar fastened to said support member said support member extending through the generally central aperture of said deformable plate, said bar being affixed to the top portion of said support member;

a switch fastened to said bar at a location distal from said support member;

a movement sensor connected to said switch and responsive to the relative displacement of said deformable plate with respect to said support member during the lifting of objects by said crane, said switch being responsive to movements of said movement sensor said movement sensor being an actuator for said switch: and control means electrically connected to said switching means and to said crane such that said movement sensor delivers a stop/go signal to said crane.

15. The sensor of claim 14, said movement sensor abutting that portion of said plate experiencing maximum deflection during the lifting of objects by said crane.

* * * * *